US011853093B2

(12) United States Patent
Okuda et al.

(10) Patent No.: US 11,853,093 B2
(45) Date of Patent: Dec. 26, 2023

(54) POWER SUPPLY DEVICE PROVIDED WITH VOLTAGE CONTROLLER USING REFERENCE VOLTAGE CIRCUIT AND CURRENT CONTROLLER, AND ELECTRONIC APPARATUS WITH THE POWER SUPPLY DEVICE

(71) Applicant: Nisshinbo Micro Devices Inc., Tokyo (JP)

(72) Inventors: Hiroki Okuda, Kyoto (JP); Takahiro Hino, Osaka (JP)

(73) Assignee: NISSHINBO MICRO DEVICES INC., Tokyo (JP)

( * ) Notice: Subject to any disclaimer, the term of this patent is extended or adjusted under 35 U.S.C. 154(b) by 245 days.

(21) Appl. No.: 17/595,941

(22) PCT Filed: Mar. 18, 2020

(86) PCT No.: PCT/JP2020/012082
§ 371 (c)(1),
(2) Date: Nov. 30, 2021

(87) PCT Pub. No.: WO2021/186635
PCT Pub. Date: Sep. 23, 2021

(65) Prior Publication Data
US 2022/0221889 A1 Jul. 14, 2022

(51) Int. Cl.
*G05F 1/59* (2006.01)
*G05F 1/46* (2006.01)
*G05F 1/614* (2006.01)

(52) U.S. Cl.
CPC ..... *G05F 1/59* (2013.01); *G05F 1/468* (2013.01); *G05F 1/614* (2013.01)

(58) Field of Classification Search
CPC . G05F 1/59; G05F 1/565; G05F 1/468; G05F 1/614
See application file for complete search history.

(56) References Cited

U.S. PATENT DOCUMENTS

2009/0224740 A1* 9/2009 Imura ..... G05F 1/575 323/282
2018/0226692 A1* 8/2018 Wong ..... H01M 10/486
(Continued)

FOREIGN PATENT DOCUMENTS

JP 60-32566 2/1985
JP 10-260743 9/1998
(Continued)

OTHER PUBLICATIONS

International Search Report dated Jun. 23, 2020 for PCT/JP2020/012082.
(Continued)

*Primary Examiner* — Rafael O De Leon Domenech
(74) *Attorney, Agent, or Firm* — Paul Teng

(57) ABSTRACT

In a power supply device, a voltage controller includes: a reference voltage circuit that generates a reference voltage based on an input voltage; a voltage control circuit that generates an output voltage of the voltage controller based on the input voltage by controlling an output current of the voltage controller so that the output voltage of the voltage controller corresponds to the reference voltage; and a first current detector circuit that detects the output current of the voltage controller, and generates a first current detection signal corresponding to the output current thereof. A current controller includes: a second current detector circuit that detects an output current of the current controller, and generates a second current detection signal corresponding to the output current thereof; and a current control circuit controls the output current of the current controller so that the second current detection signal corresponds to the first current detection signal.

5 Claims, 8 Drawing Sheets

(56) References Cited

U.S. PATENT DOCUMENTS

| | | | | |
|---|---|---|---|---|
| 2018/0269790 | A1* | 9/2018 | Uno | H02M 3/156 |
| 2019/0384337 | A1* | 12/2019 | Lu | G05F 1/575 |
| 2020/0042026 | A1* | 2/2020 | Wang | G05F 1/575 |

FOREIGN PATENT DOCUMENTS

| | | |
|---|---|---|
| JP | 2008-109736 | 5/2008 |
| JP | 2010-49482 | 3/2010 |

OTHER PUBLICATIONS

International Preliminary Report on Patentability (IPRP), dated Sep. 29, 2022 and received in connection with PCT/JP2020/012082.

* cited by examiner

101

POWER SUPPLY DEVICE PROVIDED WITH VOLTAGE CONTROLLER USING REFERENCE VOLTAGE CIRCUIT AND CURRENT CONTROLLER, AND ELECTRONIC APPARATUS WITH THE POWER SUPPLY DEVICE

TECHNICAL FIELD

The present invention relates to a power supply device including a voltage controller that is, for example, a linear regulator using a reference voltage circuit, and at least one current controller, and an electronic apparatus including the power supply device.

BACKGROUND ART

In a power supply device, for example, when a linear regulator is used, heat is generated in accordance with a difference between an input voltage and an output voltage as well as an output current. An allowable amount of the heat generation is determined by a substrate and a mold. Therefore, the output current of the linear regulator is limited and may not satisfy a required load current value. As a countermeasure, a power supply device according to Conventional Example 1 having a plurality of linear regulators connected in parallel to disperse a current has been already known.

However, in the power supply device according to conventional Example 1, the plurality of linear regulators are connected in parallel, the input terminals of the linear regulators are commonly connected to a power supply voltage in common, and the output terminals of the linear regulators are connected to a load in common. In the power supply device, the output voltages of the linear regulators having different output voltages exist due to an influence of variations in a manufacturing process etc. Therefore, the output current is supplied from the linear regulator with the highest output voltage, while in the linear regulator with a lower output voltage, an analog signal allowing a current to flow through an output transistor is sent by a differential amplifier circuit that receives a feedback voltage obtained by resistively dividing the output voltage and a reference voltage. However, since the common output voltage is fixed to a voltage higher than an output voltage of a certain linear regulator, the differential amplifier circuit outputs an analog signal for stopping the output current to the output transistor.

Subsequently, when the common output voltage drops due to an increase in load current and reaches the voltage of the linear regulator with a second highest output voltage, the differential amplifier circuit of the linear regulator with the second highest output voltage outputs an analog signal for outputting an output current to the output transistor, and the supply of the output current is started from the linear regulator with the second highest output voltage. When the output voltage of the linear regulator with a lowest common output voltage is finally reached, the output current is supplied from all the linear regulators.

However, the balance of the output current supply is not uniform, and the linear regulator with the highest output voltage supplies a large amount of the output current, so that the linear regulator with a low output voltage cannot supply an equivalent output current. As a result, a required load current value may not be satisfied. Regarding reliability, if an imbalance occurs in the current, an imbalance also occurs in heat generation, which may accelerate the life of the linear regulator with the largest output current and lead to destruction.

As means for solving the problems described above, each of the linear regulators detects a current proportional to the output current, converts the detected current value into an analog voltage signal, and transmits the analog voltage signal via a bus terminal of the linear regulator itself to a bus terminal of another linear regulator. In response, the other linear regulator adjusts the output voltage based on the analog voltage signal, in a proposed power supply device according to Conventional Example 2 (see, Patent Document 1, for example).

In the power supply device according to the conventional example 1, when the plurality of linear regulators are connected in parallel, the output current is not supplied by the linear regulator having an output voltage lower than the common output voltage as described above. However, in the power supply device according to Conventional Example 2, an analog voltage signal proportional to the output current of each linear regulator is sent to another linear regulator, and the analog voltage signal is compared with the analog voltage signal of the other linear regulator, so that the respective output currents can indirectly be compared. In this situation, a reference voltage of the linear regulator having a small output current is controlled to be raised. As a result, in the linear regulator with the low output voltage, the differential amplifier circuit that receives the feedback voltage obtained by resistively dividing the output voltage and the reference voltage sends to another linear regulator an analog voltage signal for supplying a current to the output transistor. In response, the other linear regulator stats supplying the output current. In this way, the plurality of output currents are controlled to be equal to each other by the linear regulators adjusting the reference voltage via the bus terminal.

PRIOR ART DOCUMENT

Patent Document

Patent Document 1: Japanese laid-open patent publication No. JPH10-260743A

SUMMARY OF THE INVENTION

Problem to be Solved by the Invention

However, since the analog voltage signal indicating the output current affects the reference voltage, two control signals are fed back to both of the input terminals of the error amplifier, so that the feedback control loop is crossed. Due to this effect, the control system becomes complicated, and the control system with sufficient stability cannot be designed, so that oscillation occurs, causing such a problem that a power supply device lacks stability.

An object of the present invention is to provide a power supply device capable of solving the problems described above, establishing a stable control system as compared to the conventional technologies, and preventing necessary oscillation, and an electronic apparatus including the power supply device.

Means for Solving Problems

According to one aspect of the present invention, there is provided a power supply device including a voltage controller, and at least one current controller. The power supply device is configured by connecting the voltage controller and the current controllers in parallel with each other. The voltage controller includes a reference voltage circuit, a voltage control circuit, and a first current detector circuit. The reference voltage circuit generates a predetermined reference voltage based on an input voltage, and the voltage control circuit configured to generate and output an output voltage of the voltage controller based on the input voltage by controlling an output current of the voltage controller so that the output voltage of the voltage controller becomes a voltage substantially corresponding to the reference voltage. The first current detector circuit detects the output current of the voltage controller, and generates and outputs a first current detection signal indicating a value corresponding to the output current of the voltage controller. Each of the current controllers includes a second current detector circuit, and a current control circuit. The second current detector circuit detects the output current of the current controller, and generates and outputs a second current detection signal indicating a value corresponding to the output current of the current controller, and the current control circuit configured to control an output current of the current controller so that the second current detection signal substantially becomes a value corresponding to the value indicated by the first current detection signal.

Effects of the Invention

Therefore, according to the power supply device according to the present invention, the control system of the voltage controller and the control system of each of the current controllers can be separated from each other, so that a stable control system can be established as compared to the conventional technologies to provide the power supply device etc. capable of preventing unnecessary oscillation.

MODES FOR CARRYING OUT THE INVENTION

Figure 1:
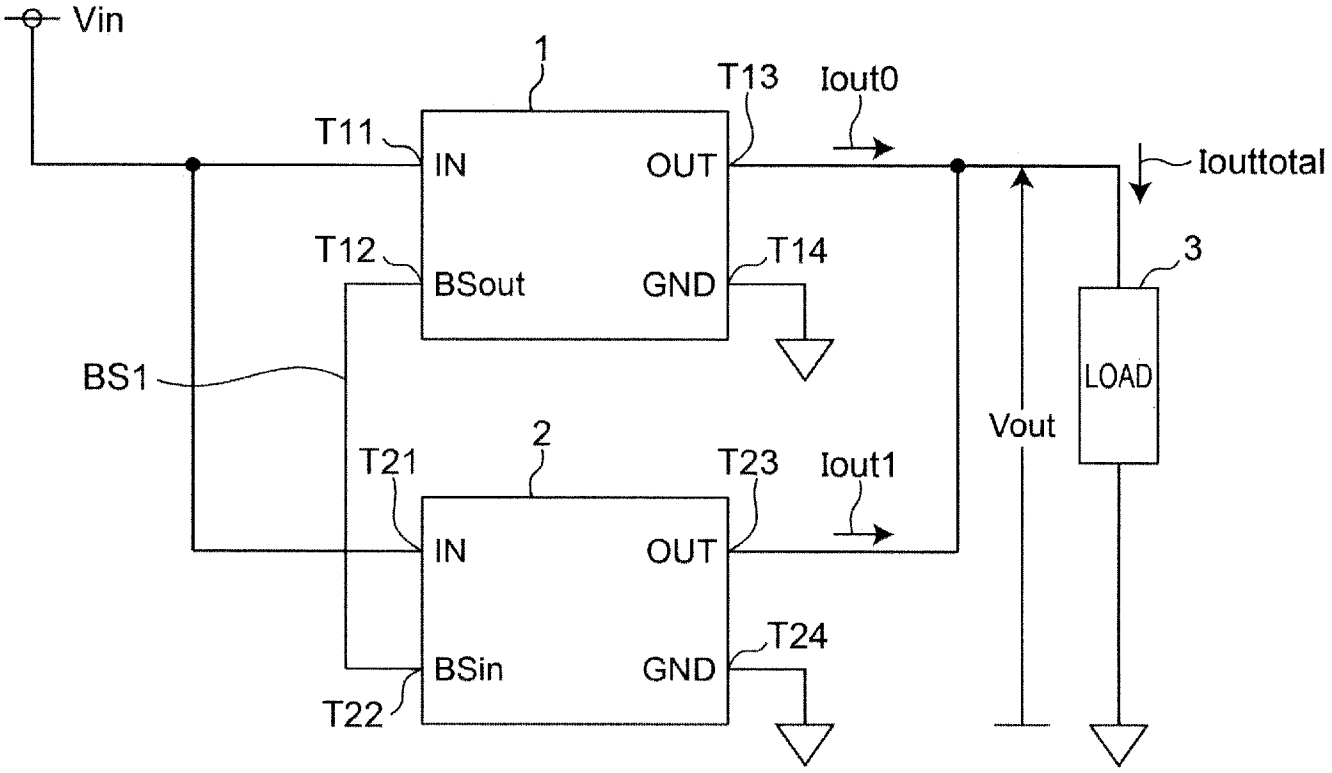
FIG. 1 is a block diagram showing a configuration example of a power supply device 101 according to a first embodiment.

Embodiments according to the present invention will now be described with reference to the drawings. The same or similar components are denoted by the same reference numerals. In this description, a MOS (Metal-Oxide Semiconductor) field effect transistor will hereinafter be referred to as a "MOS transistor".

Findings of the Inventors

As described above, the power supply device according to Conventional Example 2 disclosed in Patent Document 1 cannot solve the problem that the complexity of the control system makes it unable to ensure the stability of the circuit and results in oscillation.

On the other hand, the present embodiment is characterized in that, when the output terminals of a plurality of controllers 1 and 2 (for example, a voltage controller 1 and a current controller 2 of FIG. 1) are connected in parallel to each other, the heat generation in each of the controllers 1 and 2 is dispersed by providing dispersion control so that a plurality of output currents from the controllers 1 and 2 have a predetermined value of a ratio, or preferably, become equal to each other, thereby implementing a control system ensuring sufficient stability. Additionally, the power supply device is made up of a CMOS (Complementary Metal-Oxide Semiconductor) circuit, so that a power supply device having lower power consumption as compared to the conventional technologies can be implemented.

First Embodiment

FIG. 1 is a block diagram showing a configuration example of a power supply device 101 according to a first embodiment.

Referring to FIG. 1, the power supply device 101 is configured to include the voltage controller 1 and the current: controller 2. An input terminal T11 of the voltage controller 1 and an input terminal T21 of the current controller 2 are connected to each other, and are connected to a voltage source of an input voltage Vin. An output terminal T13 of the voltage controller 1 and an output terminal T23 of the current controller 2 are connected to each other and are connected to a load 3. As a result, the voltage controller 1 and the current controller 2 are connected in parallel with each other.

A current detection signal output terminal T12 of the voltage controller 1 and a current detection signal input terminal T22 of the current controller 2 are connected to each other, and a ground terminal T14 of the voltage controller 1 and a ground terminal T24 of the current controller 2 are connected to each other and grounded.

In FIG. 1 etc., IN denotes an input terminal of an input voltage, OUT denotes an output terminal, BSout denotes an output terminal of a current detection signal BS1, BSin denotes an input terminal of a current detection signal BS, and GND denotes a ground terminal. In this description, reference numerals such as terminals T11 to T24 will be used for description.

In the power supply device 101 configured as described above, the input voltage Vin is inputted to the input terminal T11 of the voltage controller 1 and the input terminal T21 of the current controller 2. The voltage controller 1 is a linear regulator having a built-in reference voltage circuit and controls the input voltage Vin to be a reference voltage. The total current Iouttotal obtained by summing an output current Iout0 from the voltage controller 1 and an output current Iout1 from the current controller 2 flows through the load 3.

The voltage controller 1 generates the current detection signal BS1 that is an analog voltage signal corresponding to the output current Iout0 in a predetermined correlation such as being proportional to the output current Iout0, and outputs the current detection signal BS1 from the current detection signal output terminal T12 to the current detection signal input terminal T22 of the controller 2. In response, the current controller 2 generates a current detection signal that is an analog voltage signal corresponding to the output current Iout1 in a predetermined correlation such as being proportional thereto, and compares the current detection signal with the input current detection signal BS1 to control the difference to be substantially zero, and therefore, the impedance of the output transistor (for example, a MOS transistor Q11 of FIG. 3) that controls the output current Iout1 of the current: controller 2 is controlled so that the output current Iout0 and the output current Iout1 become equal to each other, for example.

The load 3 is, for example, an electronic apparatus having a predetermined function and receiving power supply voltage and power supply current from the voltage controller 1 and the current controller 2, and specifically, an electronic apparatus for an automobile receiving power supply, or an image forming device such as a copy machine or a printer, a personal computer, a tablet, a smart phone, a mobile phone, etc., receiving power supply.

According to the first embodiment configured as described above, the voltage control system in the voltage controller 1 and the current control system in the current controller 2 are separated from each other, and therefore, do not affect each other. Thus, the power supply device 101 capable of establishing a stable control system compared to the conventional technologies and preventing unnecessary oscillation can be implemented.

In the first embodiment, the output current Iout1 of the current controller 2 is controlled so that the output current Iout0 of the voltage controller 1 and the output current Iout1 of the current controller 2 become equal to each other. However, the output current Iout1 of the current controller 2 may be controlled by current distribution so that the value of the ratio of the output current Iout0 of the voltage controller 1 to the output current Iout1 of the current controller 2 becomes a predetermined value.

Second Embodiment

Figure 2:
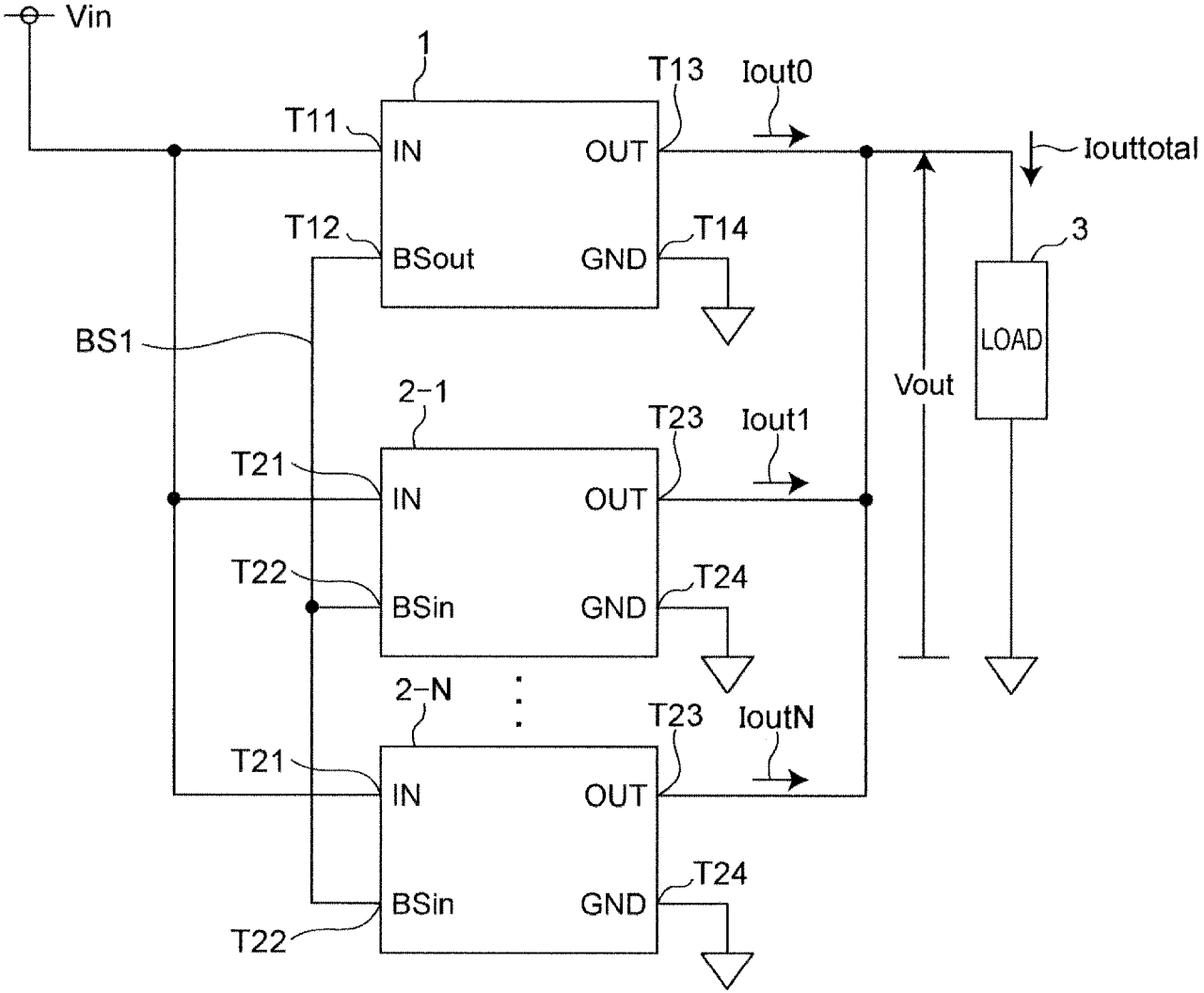
FIG. 2 is a block diagram showing a configuration example of a power supply device 102 according to a second embodiment.

FIG. 2 is a block diagram showing a configuration example of power supply device 102 according to a second embodiment.

Referring to FIG. 2, the power supply device 102 is different from the power supply device 101 of FIG. 1 in the following point:

(1) instead of the current controller 2, a plurality of N current controllers 2-1 to 2-N connected in parallel with each other are included, and the current controllers 2-1 to 2-N configured in the same manner as each other.

The differences will hereinafter be described.

Each of the current controllers 2-1 to 2-N is configured in the same manner as the current controller 2 of FIG. 1. The current detection signal BS1 from the voltage controller 1 is inputted to the current detection signal input terminals T22 of the current controllers 2-1 to 2-N. In response, each of the current controllers 2-1 to 2-N generates a current detection signal that is an analog voltage signal corresponding to each of the output currents Iout1 to IoutN in a predetermined correlation such as being proportional to each of the output currents Iout1 to IoutN, and compares the current detection signal with the input current detection signal BS1 to provide control so that the difference becomes substantially zero. Therefore, the impedances of the output transistors (for example, the MOS transistor Q11 of FIG. 3) that control the output currents Iout1 to IoutN of the current controllers 2-1 to 2-N are controlled so that the output current Iout0 and the output currents Iout1 to IoutN become equal to each other, for example.

In the power supply device 102 configured as described above, the total current Iouttotal obtained by summing the output current Iout0 of the voltage controller 1 and the output currents Iout1 to IoutN of the current controllers 2-1 to 2-N flows through the load 3. The current controllers 2-1 to 2-N control the output currents Iout1 to IoutN of the current controllers 2 so that the output currents Iout0, and the output currents Iout1 become equal to each other, for example. Since the voltage control system in the voltage controller 1 and the current control systems in the current controllers 2-1 to 2-N are separated from each other, and therefore, do not affect each other. Thus, the power supply device 102 capable of establishing a stable control system as compared to the conventional technologies and preventing unnecessary oscillation can be implemented.

Configuration Example of Voltage Controller 1

Figure 3:
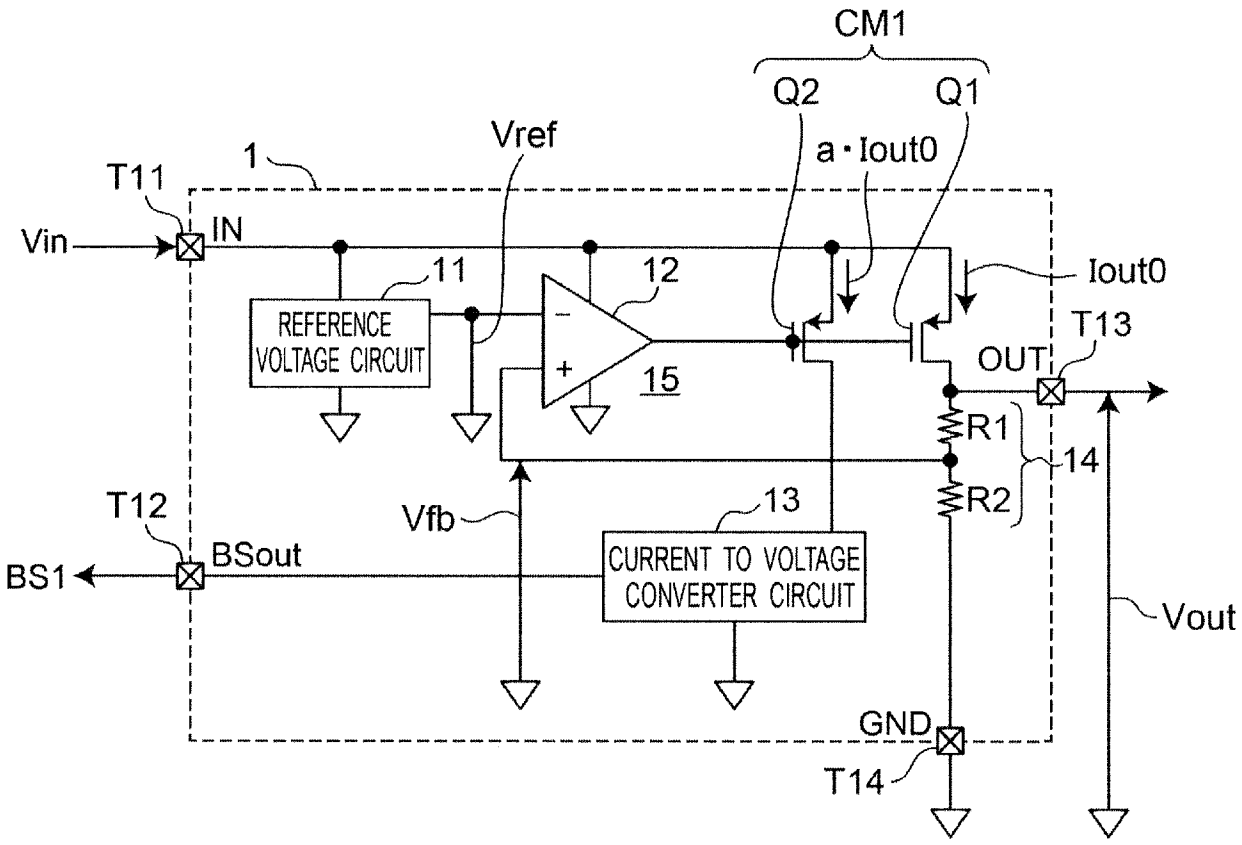
FIG. 3 is a circuit diagram showing a configuration example of a voltage controller 1 used in the power supply devices 101 and 102 of FIGS. 1 and 2.

FIG. 3 is a circuit diagram showing a configuration example of the voltage controller 1 used in the power supply devices 101 and 102 of FIGS. 1 and 2.

Referring to FIG. 3, the voltage controller 1 is configured to include a reference voltage circuit 11, an operational amplifier circuit 12, a current to voltage converter circuit 13, a voltage detector circuit 14 including voltage divider resistors R1 and R2, and a current mirror circuit CM1 including P-channel MOS transistors Q1 and Q2.

The reference voltage circuit 11 is a known reference voltage circuit (also referred to as a reference voltage source), generates a predetermined reference voltage Vref based on the input voltage Vin, and outputs the reference voltage Vref to an inverting input terminal of the operational amplifier circuit 12. The input voltage Vin is inputted as a power supply voltage to the operational amplifier circuit 12, and is outputted to the output terminal T13 via the source and drain of the MOS transistor Q1 that controls the output current Iout0 from the voltage controller 1. The output terminal T13 is grounded via the voltage divider resistors R1 and R2 connected in series with each other. The output voltage Vout of the output terminal T13 is divided by the voltage divider resistors R1 and R2 of the voltage detector circuit 14, and the voltage of the voltage divider resistor R2 after the voltage division (voltage proportional to the output voltage Vout) is inputted as a feedback voltage Vfb to the inverting input terminal of the operational amplifier circuit 12.

The operational amplifier circuit 12 outputs a difference voltage between the feedback voltage Vfb and the reference voltage Vref as an output current control signal to each of the gates (control terminals) of the MOS transistors Q1 and Q2. The voltage detector circuit 14, the operational amplifier circuit 12, and the MOS transistor Q1 configure a voltage control circuit 15, and the output current Iout0 is controlled so that the difference voltage between the feedback voltage Vfb and the reference voltage Vref becomes substantially zero, namely, so that the feedback voltage Vfb substantially matches the reference voltage Vref. As a result, the voltage control circuit 15 controls the output voltage Iout to be a predetermined voltage value (=Vref·(R1+R2)/R2).

The MOS transistors Q1 and Q2 configure a current mirror circuit CM1, and a detection current a·Iout1 proportional to the output current Iout0 flowing through the MOS transistor Q1 flows through the MOS transistor Q2 from the source to the drain toward the current to voltage converter circuit 13. The coefficient "a" is a sufficiently small value (negligible value) as compared to 1, for example, 1/10,000, or at most 1/100. The current to voltage converter circuit 13 converts the input detection current a·Iout1 into the current detection signal BS1, that is an analog voltage signal indicating the detection current, and outputs the current detection signal BS1 from the current detection signal output terminal T12.

The voltage controller 1 configured as described above includes:

(1) the reference voltage circuit 11 that generates the reference voltage Vref based on the input voltage Vin;

(2) the voltage control circuit 15 that generates and outputs the output voltage Vout of the voltage controller 1 based on the input voltage Vin, since the MOS transistor Q2 controls the output current Iout0 of the voltage controller 1 so that the output voltage Vout of the voltage controller 1 becomes a voltage substantially proportional to the reference voltage Vref; and (3) a current detector circuit (the MOS transistor Q2 and the current to voltage converter circuit 13) that detects the output current Iout0 of the voltage controller 1, and generates and outputs the current detection signal BS1 indicating a value corresponding to the output current Iout0.

As a result, the voltage controller 1 converts the input voltage Vin into the output voltage Vout proportional to the reference voltage Vref, and outputs the current detection signal BS1 indicating a value proportional to the output current Iout0.

Configuration Example of Current Controller 2

Figure 4:
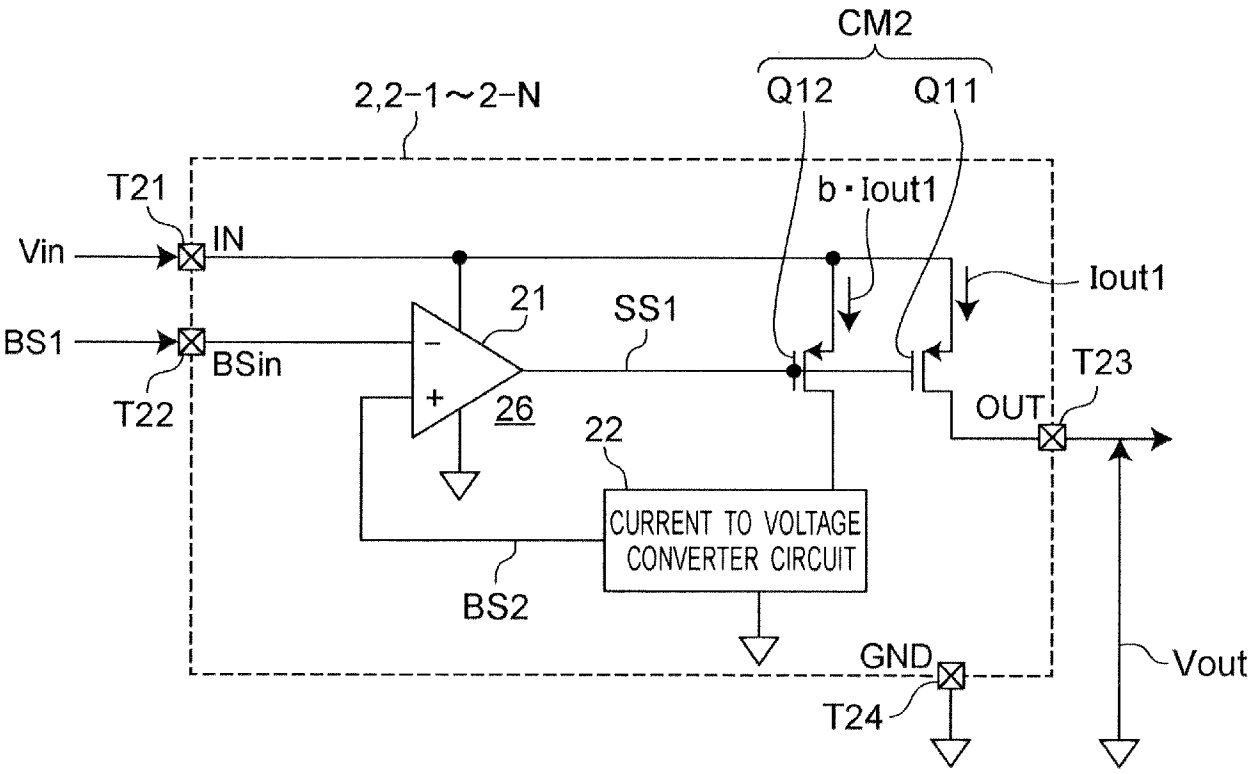
FIG. 4 is a circuit diagram showing a configuration example of current controllers 2 and 2-1 to 2-N used in the power supply devices 101 and 102 of FIGS. 1 and 2.

FIG. 4 is a circuit diagram showing a configuration example of the current controllers 2 and 2-1 to 2-N (hereinafter collectively denoted by reference numeral 2) used in the power supply devices 101 and 102 of FIGS. 1 and 2.

Referring to FIG. 4, the current controller 2 includes an operational amplifier circuit 21, a current to voltage converter circuit 22, and a current mirror circuit CM2 including P-channel MOS transistors Q11 and Q12.

The input voltage Vin is inputted as a power supply voltage to the operational amplifier circuit 21 and is outputted to the output terminal T23 via the source and drain of the MOS transistor Q11 that controls the output current Iout1 from the voltage controller 1.

The MOS transistors Q11 and Q12 configures a current mirror circuit CM2, and the detection current b•Iout1 proportional to the output current Iout1 flowing through the MOS transistor Q11 flows through the MOS transistor Q12 from the source to the drain toward the current to voltage converter circuit 22. The coefficient "b" is a sufficiently small value (negligible value) as compared to 1, for example, 1/10,000, or at most 1/100. The current to voltage converter circuit 22 converts the input detection current b•Iout1 into a current detection signal BS2 that is an analog voltage signal indicating the detection current and outputs the current detection signal BS2 to the non-inverting input terminal of the operational amplifier circuit 21. The coefficient "b" may be set equal to or different from the coefficient "a".

The operational amplifier circuit 21 outputs a difference voltage signal between the current detection signal BS2 and the current detection signal BS1 as an output current control signal SS1 to the gates (control terminals) of the MOS transistors Q11, Q12. The operational amplifier circuit 21, the MOS transistor Q12, and the current to voltage converter circuit 22 configure a current control circuit 26, and the output current Iout1 is controlled so that the difference voltage between the current detection signal BS2 and the current detection signal BS1 becomes substantially zero, namely, so that the current detection signal BS2 substantially matches the current detection signal BS1. As a result, the current control circuit 26 controls the output current Iout1 to be equal to a predetermined current value (for example, be equal to the output current Iout0 of the voltage controller 1, be a current value proportional to the output current Iout0 of the voltage controller 1).

The current controller 2 configured as described above includes:

(1) a current detector circuit (the MOS transistor Q2 and the current to voltage converter circuit 22) that detects the output current Iout1 of the current controller 2, and generates and outputs the current detection signal BS2 indicating a value corresponding to the output current Iout1; and (2) the current control circuit 26 that controls the output current Iout1 of the current controller 2 so that the current detection signal BS2 substantially becomes a value corresponding to the value indicated by the current detection signal BS1.

As a result, the current controller 2 controls the output current Iout1 of the current controller 2 so that the current detection signal BS2 substantially becomes a value corresponds to the value indicated by the current detection signal BS1.

Detailed Configuration of Power Supply Device 101

Figure 5:
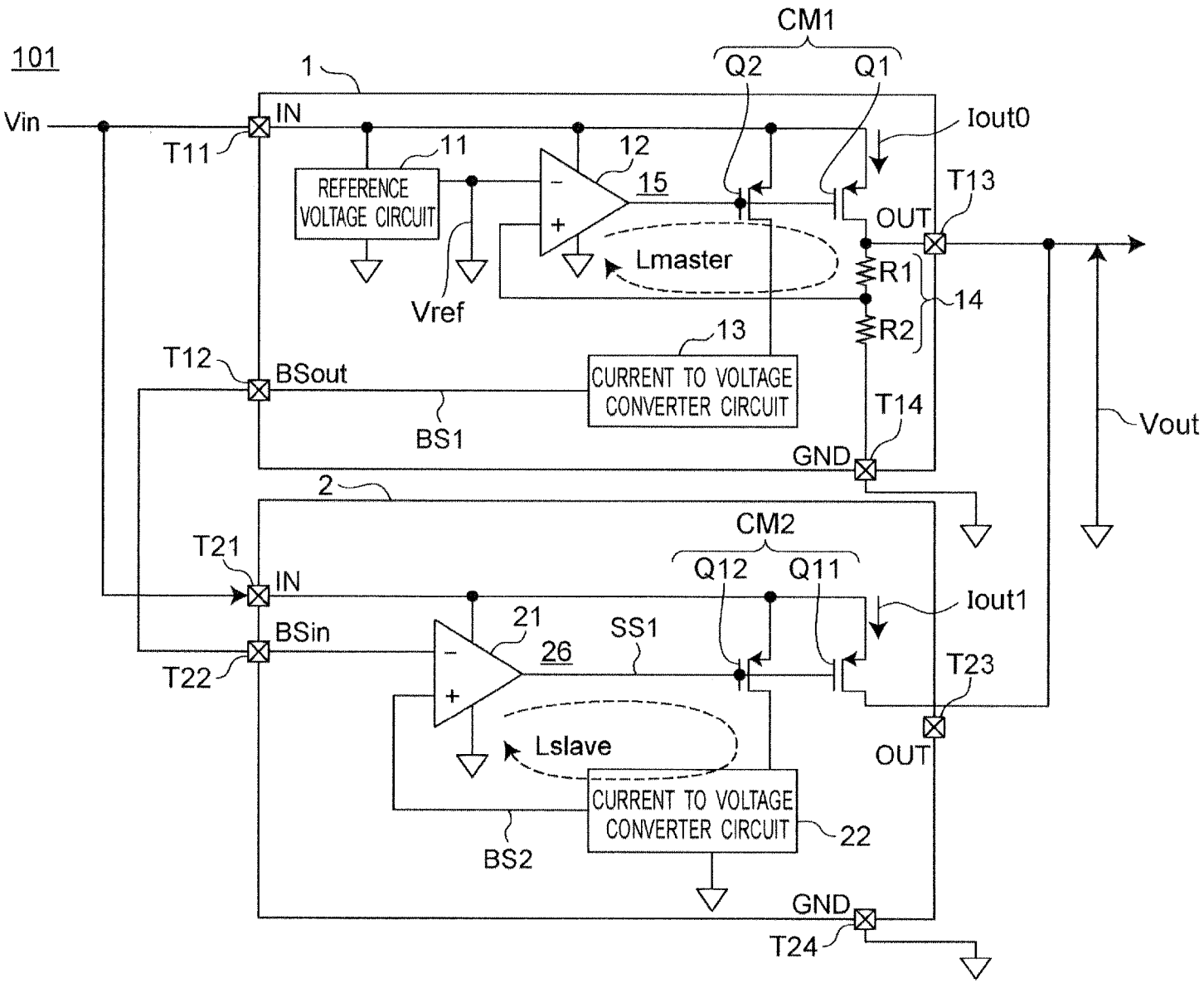
FIG. 5 is a circuit diagram showing a detailed configuration of the power supply device 101 of FIG. 1.

FIG. 5 is a circuit diagram showing a detailed configuration of the power supply device 101 of FIG. 1. The circuit diagram of FIG. 5 is shown so that the voltage controller 1 of FIG. 3 and the current controller 2 of FIG. 4 are inserted into the power supply device 101 of FIG. 1.

Referring to FIG. 5, the voltage controller 1 has a closed control loop Lmaster of the voltage control circuit 15 that controls the output voltage Vout. On the other hand, the current controller 2 has a closed control loop Lslave of the current control circuit 26 that controls the output current Iout1. In the power supply device 101, the closed control loop Lmaster and the closed control loop Lslave do not overlap on each other, and therefore, the respective control loops Lmaster and Lslave can independently be designed to ensure the stability and prevent the complication. When the response of the closed control loop Lslave does not significantly affect the response of the closed control loop Lmaster, a phase margin and a gain margin can be determined substantially only by the closed control loop Lmaster.

EXAMPLE 1

Figure 6:
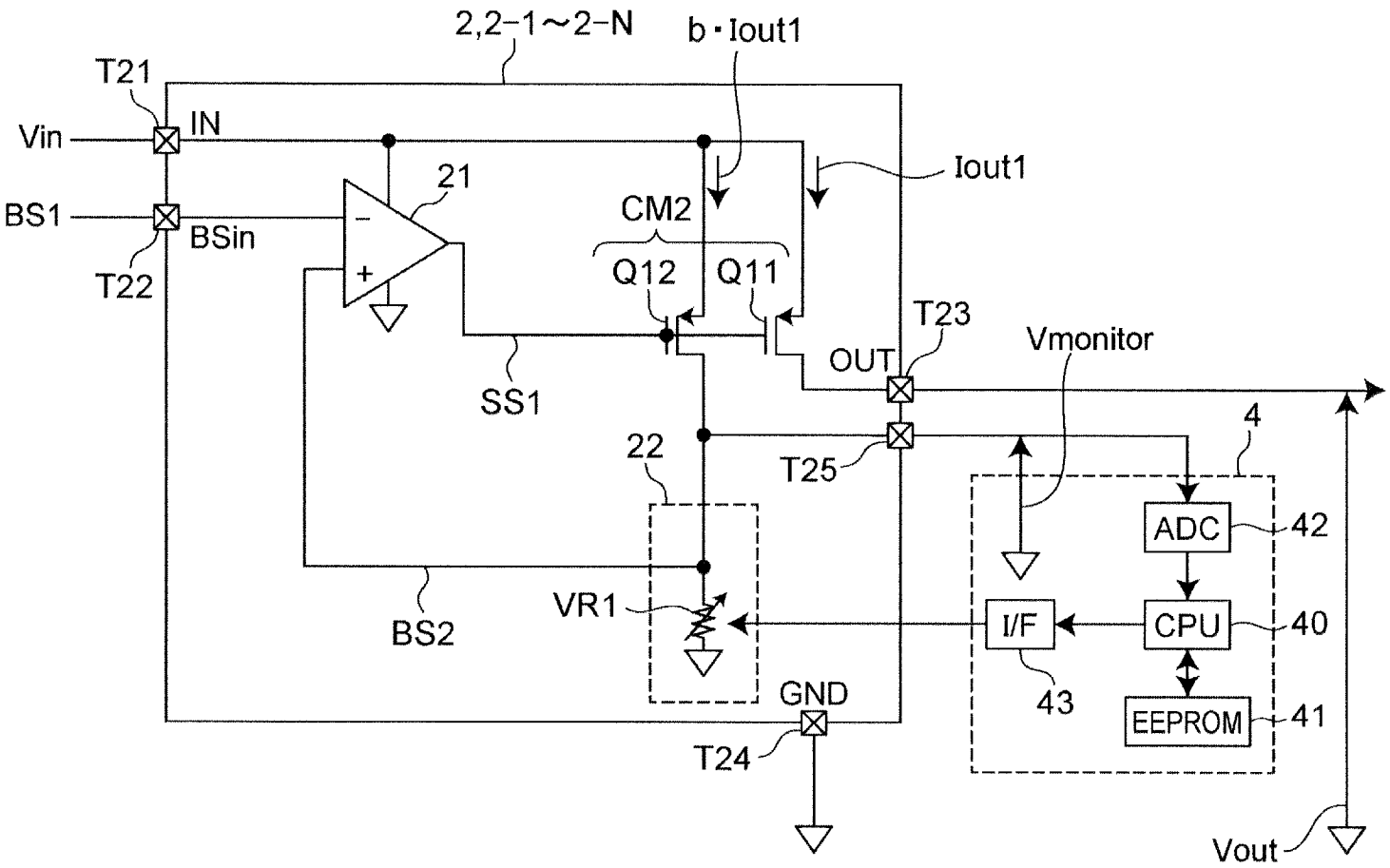
FIG. 6 is a circuit diagram showing a configuration example according to Example 1 of the current controllers 2 and 2-1 to 2-N of FIG. 4.

FIG. 6 is a circuit diagram showing a configuration example according to Example 1 of the current controllers 2 and 2-1 to 2-N (collectively denoted by reference numeral 2 in Example 1) of FIG. 4. In FIG. 6, the reference numerals of FIG. 3 are used for the output current Iout1 and the detection current b•Iout1.

Referring to FIG. 6, the current controller 2 according to Example 1 is different from the current controller 2 of FIG. 4 in the following points:

(1) a specific example of the current to voltage converter circuit 22 made up of the variable resistor VR1 is shown;

(2) a voltage at the input end of the current to voltage converter circuit 22 is outputted as a monitor voltage Vmonitor via the terminal T25; and (3) the power supply devices 101 and 102 includes a current setting controller 4 that controls a variable resistor VR1 based on the monitor voltage Vmonitor.

The differences will hereinafter be described.

Referring to FIG. 6, the detection current b•Iout1 detected by the MOS transistor Q12 is grounded via the variable resistor VR1, and the voltage between both ends of the variable resistor VR1 is inputted to the non-inverting input terminal of the operational amplifier circuit 21 as the current detection signal BS2. Therefore, the variable resistor VR1 inputs and converts the detection current b•Iout1 into an analog voltage signal by using a predetermined transfer impedance, and outputs the analog voltage signal as the current detection signal BS2. The transfer impedance between the output current Iout1 of the MOS transistor Q11 and the voltage of the current detection signal BS2 applied to the non-inverting input terminal of the operational amplifier circuit 21 is determined by a current ratio "b" between the MOS transistor Q11 and the MOS transistor Q12, and an absolute value of a resistance value of the variable resistor VR1.

The variable resistor VR1 may have the following forms, for example:

(Form A) The variable resistance VR1 is configured to include a plurality of resistance elements connected in series with each other, and switching elements connected in parallel with the respective resistance elements, and the resistance value of the variable resistance VR1 is changed and set by turning on or off each of the switching elements.

(Form B) The variable resistance VR1 is configured to include a plurality of resistance elements connected in series with each other and fuse elements connected in parallel with the respective resistance elements, and the resistance value of the variable resistance VR1 is changed and set by laser-trimming each of the fuse elements.

Some variations exist in the current ratio between the MOS transistor Q11 and the MOS transistor Q12, and the variable resistor VR1. Therefore, the transfer impedance between the output current Iout1 of the MOS transistor Q11 and the voltage of the current detection signal BS2 of the current to voltage converter circuit 22 may deviate from a predetermined value, and as a result, a difference occurs between the output currents Iout0 to IoutN of the voltage controller 1 and the current controllers 2 connected in parallel. In such a case, by adjusting the resistance value of the variable resistor VR1, the transfer impedance between the MOS transistor Q11 and the non-inverting input terminal of the operational amplifier circuit 21 can be adjusted to a predetermined value, and the difference can be reduced in the output currents Iout0 to IoutN of the voltage controller 1 and the current controllers 2.

In Example 1 of FIG. 6, in order to suppress not only the variation of the variable resistor VR1 but also the variation of the transfer impedance, a terminal T25 for measuring the monitor voltage Vmonitor corresponding to the transfer impedance is disposed. The current detection signal BS1 can be used in the current to voltage converter circuit 13 of the voltage controller 1 of FIG. 3.

The current setting controller 4 is disposed as a setting circuit for automatically controlling the resistance value of the variable resistor VR1 based on the monitor voltage Vmonitor. This automatic control may be performed in real time or may be executed in a predetermined cycle.

The current setting controller 4 is configured to include a CPU (Central Processing Unit) 41, an EEPROM (Electrically Erasable Programmable Read-Only Memory) 42, an AD converter (ADC) 42, and an interface circuit (I/F) 43. The EEPROM 41 may be a ROM (Read Only Memory) depending on a type of usage. The EEPROM 41 preliminarily sores a relation table of the set clue of the variable resistor VR1 for the monitor voltage Vmonitor according to the set current ratio of the output current Iout0 of the voltage controller 1 to each of the output currents Iout1 to IoutN of the current controllers 2 (the case that the currents are equal to each other and the case that the currents are different from each other).

The AD converter 42 converts the monitor voltage Vmonitor into a digital voltage value, and outputs the digital voltage value to the CPU 40. The CPU 40 retrieves the set value of the resistance value of the variable resistor VR1 corresponding to the digital voltage value of the input monitor voltage Vmonitor from the relation table in the EEPROM 41, and sets the resistance value of the variable resistor VR1 via the interface circuit 43. For example, if the variable resistor VR1 is the form A, the resistance value of the variable resistor VR1 is set to a predetermined value by turning on or off the switching elements of the variable resistor VR1.

The current setting controller 4 can accurately measure the transfer impedance in consideration of the variation in the respective elements described above, and can set the resistance value of the variable resistor VR1 via the interface circuit 43 so as to adjust the transfer impedance to a predetermined value. As a result, the value of the coefficient "b" can be changed, and the output current Iout1 of the current controller 2 can be adjusted and set.

Example 1 configured as described above further includes the current setting controller 4 that sets the ratio of the output current from the voltage controller 1 to the output current from each of the current controllers 2, into a predetermined value. The variable resistor VR1 divides the detection current b•Iout detected by the MOS transistor Q12 at a predetermined current ratio, and outputs the divided current to the operational amplifier circuit 21.

In Example 1 of FIG. 6 described above, the current setting controller 4 is used. However, the present invention is not limited thereto, and the variable resistor VR1 may be configured in the form B without using the current setting controller 4, and the variable resistor VR1 may be adjusted and set by a laser trimming method, while, for example, the manufacturer measures the monitor voltage Vmonitor with a voltmeter. However, when the transfer impedance is adjusted by the laser trimming method, the adjustment is made in the direction of increasing the resistance value of the variable resistor VR1, and therefore, it is preferable to achieve a configuration in which the transfer impedance before trimming is set to a value slightly lower than the predetermined value and the transfer impedance is increased to a predetermined value by trimming.

The variable resistor VR1 may be shipped as a fixed value after being adjusted at the time of manufacturing before shipment. When the value of the variable resistor VR1 at the time of design is not different from the resistance value at the time of manufacturing, the variable resistor VR1 may be a fixed resistance.

Although FIG. 6 shows a specific example of the current to voltage converter circuit 22, the current to voltage converter circuit 13 of the voltage controller 1 may have the same configuration. Furthermore, the current setting controller 4 of FIG. 6 may be made up of a DSP (Digital Signal Processor) etc.

EXAMPLE 2

Figure 7:
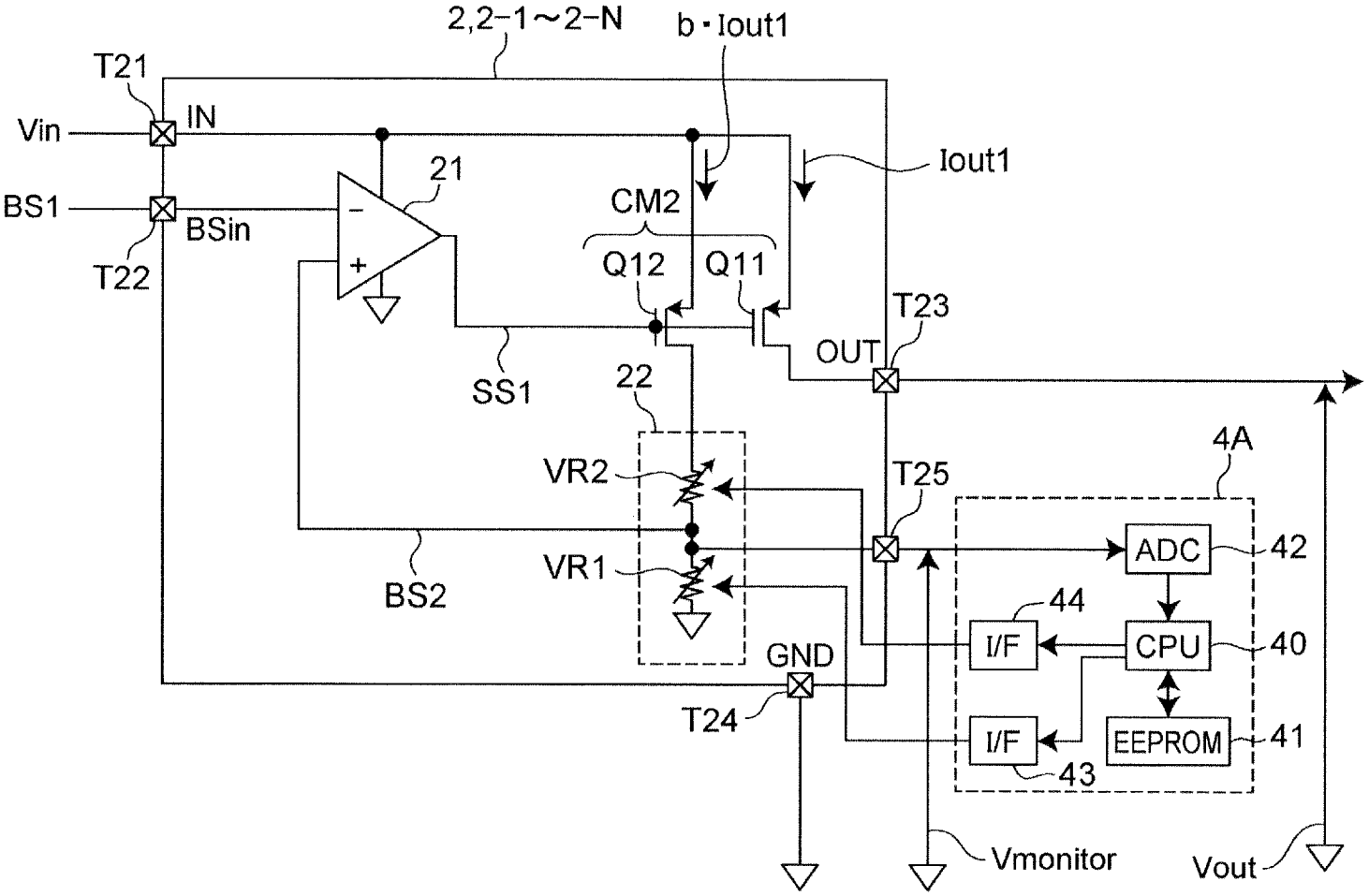
FIG. 7 is a circuit diagram showing a configuration example according to Example 2 of the current controllers 2 and 2-1 to 2-N of FIG. 4.

FIG. 7 is a circuit diagram showing a configuration example according to Example 2 of the current controllers 2 and 2-1 to 2-N (collectively denoted by reference numeral 2 in Example 2) of FIG. 4. In FIG. 7, the reference numerals of FIG. 3 are used for the output current Iout1 and the detection current b•Iout1.

Referring to FIG. 7, the current controller 2 according to. Example 2 is different from the current controller 2 of FIG. 6 in the following points:

(1) a specific example of the current to voltage converter circuit 22 made up of the variable resistors VR1 and VR2 is shown; and (2) instead of the current setting controller 4, a current setting controller 4A including an interface circuit 44 capable of controlling the variable resistor VR2 is disposed.

The differences will hereinafter be described.

Referring to FIG. 7, the current to voltage converter circuit 22 inputs and converts the detection current b•Iout1 detected by the MOS transistor Q12 into the current detection signal BS2 that is an analog voltage signal by using a predetermined transfer impedance, and outputs the analog voltage signal to the non-inverting input terminal of the operational amplifier circuit 21. The transfer impedance between the output current Iout1 of the MOS transistor Q11 and the voltage of the current detection signal BS2 inputted to the non-inverting input terminal of the operational amplifier circuit 21 can be determined by the current ratio "b" of the MOS transistor Q11 and the MOS transistor Q12, the voltage division ratio of the variable resistors VR1 and VR2, and the absolute value thereof.

The current setting controller 4A can accurately measure the transfer impedance in consideration of the variation in the respective elements described above, and can set the resistance values of the variable resistors VR1 and VR2 via the interface circuits 43 and 44 so as to adjust the transfer impedance to a predetermined value. As a result, the value of the coefficient "b" can be changed, and the output current Iout1 of the current controller 2 can be adjusted and set.

Example 2 configured as described above further includes the current setting controller 4 that sets the ratio of the output current from the voltage controller 1 to the output current from the current controllers 2 into a predetermined value. The variable resistors VR1 and VR2 divide the detection current b•Iout detected by the MOS transistor Q12 at a predetermined voltage division ratio, and divide the same current at a predetermined current ratio, and then outputting the divided current to the operational amplifier circuit 21.

A modification of Example 1 can similarly be applied to Example 2.

EXAMPLE 3

Figure 8:
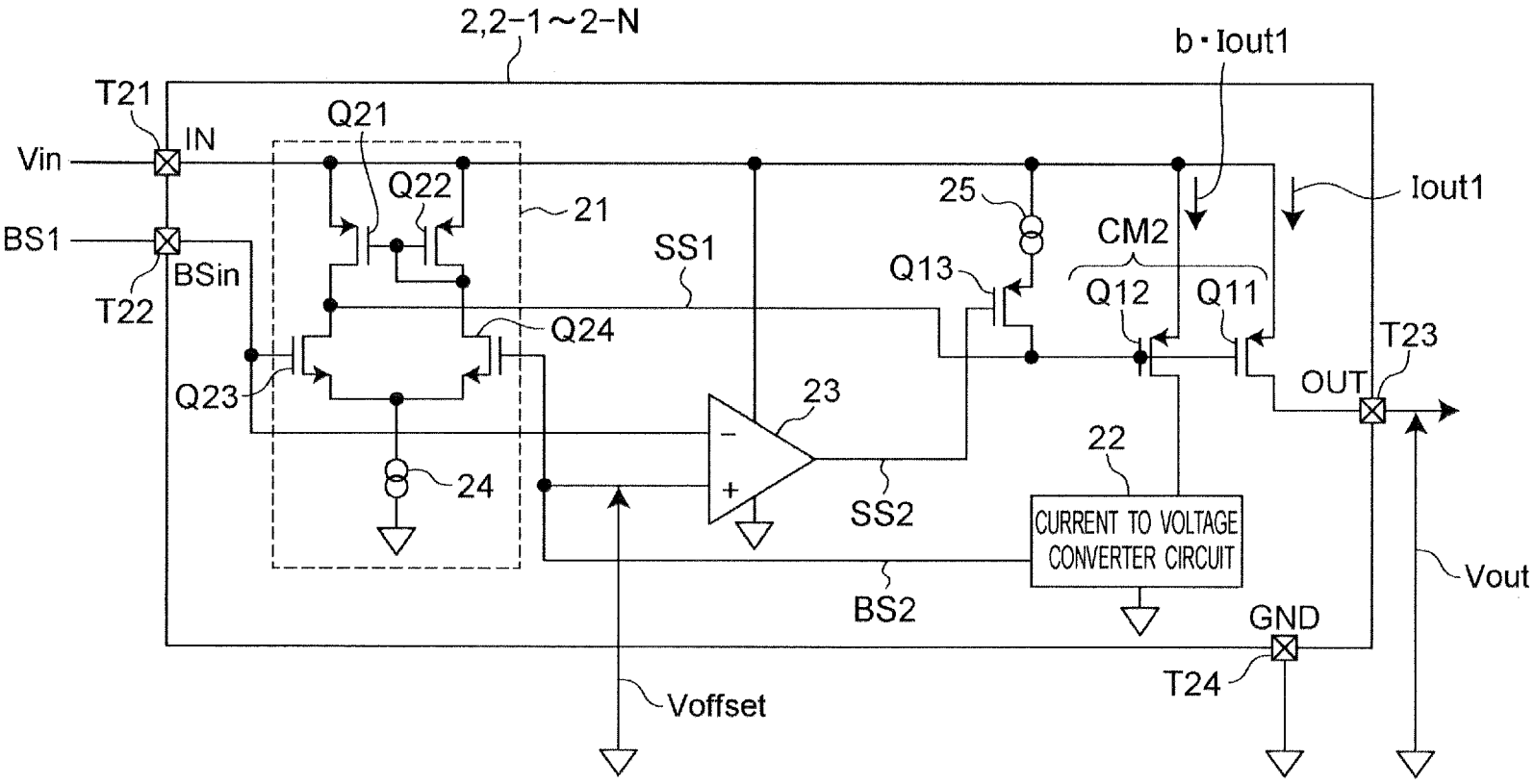
FIG. 8 is a circuit diagram showing a configuration example according to Example 3 of the current controllers 2 and 2-1 to 2-N of FIG. 4.

FIG. 8 is a circuit diagram showing a configuration example according to Example 3 of the current controllers 2 and 2-1 to 2-N of FIG. 4 (collectively denoted by reference numeral 2 in Example 3). In FIG. 8, the reference numerals of FIG. 3 are used for the output current Iout1 and the detection current b•Iout1.

The current controller 2 according to Example 3 of FIG. 8 is different from the current controller 2 of FIG. 4 in the following points:

(1) the operational amplifier circuit 21 is a known operational amplifier circuit and is configured to include four MOS transistors Q21 to Q24 and a constant current source 24 that is a so-called tail current source;

(2) a series circuit of a constant current source 25 and a P-channel MOS transistor Q13 serving as a switching element is connected between the input voltage Vin and the output terminal of the operational amplifier circuit 21; and (3) an operational amplifier circuit 23 for switching on/off of the MOS transistor Q13 is included.

The differences will hereinafter be described. Example 3 of FIG. 8 provides circuit configuration for improving the responsiveness of the power supply devices 101 and 102.

Referring to FIG. 8, the input voltage Vin is inputted as a power supply voltage to the operational amplifier circuit 23, and the voltage of the current detection signal BS1 is inputted to each of the inverting input terminals of the operational amplifier circuits 21 and 23. The voltage of the current detection signal BS2 of the current to voltage converter circuit 22 is inputted to the non-inverting input terminal of the operational amplifier circuit 23. The operational amplifier circuit 23 generates a switch control signal SS2 according to the two input signal voltages, and outputs the switch control signal SS2 to a date of the MOS transistor Q13.

When the voltage of the current detection signal BS1 becomes equal to or less than a predetermined threshold value, the operational amplifier circuit 23 outputs a switch control signal for turning on the MOS transistor Q13 to the gate of the MOS transistor Q13. As a result, the responsiveness of the output current Iout1 is improved by supplying the MOS transistor Q11 with a constant current from the constant current source 25 operated by the input voltage Vin.

When the voltage of the current detection signal BS1 becomes equal to or less than a predetermined threshold value, namely, when the output current Iout1 of the current controller 2 exceeds the output current Iout0 of the voltage controller 1, the MOS transistor Q13 is turned on to improve the responsiveness by making the constant current of the constant current source 25 sufficiently large relative to an amount of current of the constant current source 24 of the operational amplifier circuit 21. This can suppress the overshoot of the output voltage Vout due to a response delay in the output current Iout1 of the current controller 2, which occurs when the state transitions from a heavy load to a light load.

In the embodiment, since the response characteristics of the voltage controller 1 and the current controller 2 are not the same as each other due to the single loop of the current controller 2, and the responsiveness at the time of switching from a heavy load to a light load is determined by the characteristic of the controller with the slower response, it is important to improve the characteristic of the controller with the slower response when the responsiveness is improved. In this case, if the response of the current controller 2 is slower than that of the voltage controller 1, the circuit of FIG. 8 for improving the responsiveness of the current controller 2 is required.

Example 3 configured as described above includes: (1) a constant current source 25 that generates a predetermined constant current based on the input voltage Vin;

(2) the MOS transistor Q11 that is a current control element that includes a gate (control terminal) for inputting the output current control signal SS1 and that controls the output current Iout1 from the current controller 2 based on the output current control signal SS1; and (3) the MOS transistor Q13 that is a switch element for inputting the constant current to the gate of the MOS transistor Q11 when the current: detection signal SS2 becomes equal to or less than a predetermined threshold value.

This can suppress the overshoot of the output voltage Vout due to a response delay in the output current Iout1 of the current controller 2, which occurs when the state transitions from a heavy load to a light load.

The circuit of Example 3 may be applied to Example 1 or 2.

Effects of Embodiments

As described above, according to the present embodiments, the voltage controller 1 and each of the current controllers 2 are connected in parallel with each other to transmit the current detection signal BS1 obtained by detecting a portion of the output current Iout0 of the voltage controller 1 to the current controllers 2, and the output currents Iout1 to IoutN of the current controllers 2 are controlled based on the difference signal between the current detection signal BS1 and the current detection signal BS2 obtained by detecting a portion of the output currents Iout1 to IoutN of the current controllers 2. As a result, as shown in FIG. 5, the voltage controller 1 has only the closed control loop Lmaster for controlling the output voltage Vout, and each of the current controllers 2 has only the closed control loop Lslave for controlling the output currents Iout1 to IoutN. Therefore, the feedback control loops are not crossed in the internal circuits of the power supply devices 101 and 102, and the voltage controller 1 and the current controllers 2 are not configured in the same manner so as to each response frequency can be separated from each other, so that the loss of stability due to resonance between respective responses can be prevented.

The control system of each of the current controllers 2 can implement characteristics different from the response frequency of the voltage controller 1, and the respective response frequencies can be separated from each other. This can prevent the loss of stability due to the resonance between respective responses.

When an offset voltage Voffset (FIG. 8) of the operational amplifier circuit 23 for comparing the output current detection signal BS1 with the current detection signal BS2 becomes larger than the predetermined value, the difference signal of the current detection signals BS1 and BS2 of the voltage controller 1 and the current controllers 2 is generated, and the difference occurs in the output current amount. However, when the amplification factor of the output current detection signal BS1 is increased, the sensitivity of the offset voltage Voffset of the operational amplifier circuit 23 to the current difference is lowered, and the design in the CMOS circuit is facilitated, so that the control system having a configuration with lower consumption can be implemented.

Modified Embodiment

In the embodiments, the case of use for the voltage control circuit has been described as an example. However, this is an example, the present invention is not limited thereto and can be applied to all control circuits by using an operational amplifier circuit. For example, the present invention may be applied to the current control circuit.

INDUSTRIAL APPLICABILITY

As mentioned above in detail, according to the power supply device of the present invention, the control system of the voltage controller and the control system of each of the current controllers can be separated from each other, so that the stable control system can be established as compared to the conventional technologies to provide the power supply device etc. capable of preventing unnecessary oscillation.

An electronic apparatus may be configured to include the power supply device 101 and 102 according to the embodiments and the load 3. The electronic apparatus is, for example, an electronic apparatus for an automobile receiving power supply, or an image forming device such as a copy machine or a printer, a personal computer, a tablet, a smart phone, a mobile phone, etc., that receive the power supplies.

The invention claimed is:

1. A power supply device comprising:

a voltage controller; and at least one current controller, wherein the power supply device is configured by connecting the voltage controller and the current controllers in parallel with each other, wherein the voltage controller comprises:

a reference voltage circuit that generates a predetermined reference voltage based on an input voltage;

a voltage control circuit configured to generate and output an output voltage of the voltage controller based on the input voltage by controlling an output current of the voltage controller so that the output voltage of the voltage controller becomes a voltage substantially corresponding to the reference voltage; and a first current detector circuit that detects the output current of the voltage controller, and generates and outputs a first current detection signal indicating a value corresponding to the output current of the voltage controller, wherein each of the current controllers comprises:

a second current detector circuit that detects the output current of the current controller, and generates and outputs a second current detection signal indicating a value corresponding to the output current of the current controller; and a current control circuit configured to control the output current of the current controller so that the second current detection signal substantially becomes a value corresponding to the value indicated by the first current detection signal, wherein the current control circuit further comprises a setting circuit that sets a ratio of the output current from the voltage controller to the output current from each of the current controllers into a predetermined value, and wherein the setting circuit comprises a first variable resistor that divides the second current detection signal at a predetermined current ratio, and outputs a divided second current detection signal to the current control circuit.

2. The power supply device as claimed in claim 1, wherein the setting circuit comprises first and second variable resistors connected in series with each other, the first and second variable resistors dividing the second current detection signal at a predetermined voltage ratio, and outputting the second current detection signal to the current control circuit.

3. The power supply device as claimed in claim 1, wherein the current control circuit further comprises a control circuit that is configured to control the setting circuit so that a ratio of the output current from the voltage controller to the output current from each of the current controllers becomes a predetermined value based on the second current detection signal.

4. The power supply device as claimed in claim 1, wherein the current control circuit comprises:

a constant current source that generates a predetermined constant current based on the input voltage;

a first operational amplifier circuit that generates a first difference signal between the first current detection signal and the second current detection signal;

a second operational amplifier circuit that generates a second difference signal between the first current detection signal and the second current detection signal;

a current control element including a control terminal for inputting the first difference signal, the current control element being configured to control the output current from the current controller based on the first difference signal; and a switch element that inputs the constant current to the control terminal of the current control element when the second difference signal becomes equal to or less than a predetermined threshold value.

5. An electronic apparatus comprising a power supply device, wherein the power supply device comprises:

a voltage controller; and at least one current controller, wherein the power supply device is configured by connecting the voltage controller and the current controllers in parallel with each other, wherein the voltage controller comprises:

a reference voltage circuit that generates a predetermined reference voltage based on an input voltage;

a voltage control circuit configured to generate and output an output voltage of the voltage controller based on the input voltage by controlling an output current of the voltage controller so that the output voltage of the voltage controller becomes a voltage substantially corresponding to the reference voltage; and a first current detector circuit that detects the output current of the voltage controller, and generates and outputs a first current detection signal indicating a value corresponding to the output current of the voltage controller, wherein each of the current controllers comprises:

a second current detector circuit that detects the output current of the current controller, and generates and outputs a second current detection signal indicating a value corresponding to the output current of the current controller; and a current control circuit configured to control the output current of the current controller so that the second current detection signal substantially becomes a value corresponding to the value indicated by the first current detection signal, wherein the current control circuit further comprises a setting circuit that sets a ratio of the output current from the voltage controller to the output current from each of the current controllers into a predetermined value, and wherein the setting circuit comprises a first variable resistor that divides the second current detection signal at a predetermined current ratio, and outputs a divided second current detection signal to the current control circuit.

* * * * *